US010308041B2

(12) United States Patent
Washizawa

(10) Patent No.: US 10,308,041 B2
(45) Date of Patent: Jun. 4, 2019

(54) PRINTING APPARATUS

(71) Applicant: SEIKO EPSON CORPORATION, Tokyo (JP)

(72) Inventor: Takehito Washizawa, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/845,890

(22) Filed: Dec. 18, 2017

(65) Prior Publication Data

US 2018/0178554 A1 Jun. 28, 2018

(30) Foreign Application Priority Data

Dec. 22, 2016 (JP) ..... 2016-248821

(51) Int. Cl.

| | |
|---|---|
| ***B41J 11/00*** | (2006.01) |
| ***B41J 13/10*** | (2006.01) |
| ***B41J 2/01*** | (2006.01) |
| ***B41J 11/06*** | (2006.01) |

(52) U.S. Cl.

CPC ..... *B41J 11/0015* (2013.01); *B41J 2/01* (2013.01); *B41J 11/001* (2013.01); *B41J 11/002* (2013.01); *B41J 11/005* (2013.01); *B41J 11/06* (2013.01); *B41J 13/10* (2013.01)

(58) Field of Classification Search

CPC ..... B41J 2/01; B41J 11/001; B41J 11/0015; B41J 11/002; B41J 11/005; B41J 11/06; B41J 13/10

See application file for complete search history.

(56) References Cited

U.S. PATENT DOCUMENTS

| | | | | |
|---|---|---|---|---|
| 5,425,588 | A * | 6/1995 | Stemmle | B41J 11/02 400/649 |
| 6,293,669 | B1 * | 9/2001 | Uchida | B41J 11/005 347/104 |
| 6,820,975 | B2 * | 11/2004 | Sugaya | B41J 2/2114 347/102 |
| 6,860,665 | B2 * | 3/2005 | Elgee | B41J 19/202 400/582 |
| 2011/0050826 | A1 | 3/2011 | Katagami et al. | |

FOREIGN PATENT DOCUMENTS

| | | |
|---|---|---|
| JP | 2004-230839 | 8/2004 |
| JP | 2011-016268 | 1/2011 |
| JP | 2011-046485 | 3/2011 |
| WO | 2010116933 A1 | 10/2010 |

* cited by examiner

*Primary Examiner* — Anh T Vo
(74) *Attorney, Agent, or Firm* — Workman Nydegger

(57) ABSTRACT

A printing apparatus includes a medium supporting portion for supporting a medium, a head for printing on the medium, a medium pressing member that includes a plurality of materials stacked thereon, and a platen heater for heating the medium pressing member. The medium pressing member includes a base portion being attached to the medium supporting portion, and an eaves portion which forms a gap with the medium supporting portion and suppresses floating of the medium from the medium supporting portion. The base portion includes a first material for forming a first surface being attached to the medium supporting portion, and a second material for forming a second surface on an opposite side of the first surface, and a coefficient of thermal expansion of the first material is higher than a coefficient of thermal expansion of the second material.

6 Claims, 6 Drawing Sheets

PRINTING APPARATUS

BACKGROUND

1. Technical Field

The present invention relates to a printing apparatus.

2. Related Art

A printing apparatus that discharges liquid (ink) to a medium such as paper or a printing sheet from a head and performs printing on the medium is known.

For example, a printing apparatus (printer apparatus) disclosed in JP-A-2011-16268 includes a head discharging ink to a medium, a first platen provided in a drawing region to be drawn by the head, a second platen positioned on a downstream side of the drawing region in a transporting direction of the medium, and a guide member (medium pressing member) pressing the medium from a top of the first platen to a top of the second platen.

According to this configuration, since the medium is widely pressed by the medium pressing member, skewing of the medium or floating of the medium from the platen is suppressed, and thereby the medium can be stably transported.

The medium pressing member is disposed between the head and the platen, and between the head and the medium. In order to increase a quality of the image being printed on the medium, an interval between the head and the medium needs to be reduced, and thus the medium pressing member being disposed between the head and the medium needs to be thin.

In the printing apparatus disclosed in JP-A-2011-16268, since a thin medium pressing member is widely provided, compared to a case in which the thin medium pressing member is narrowly provided, a mechanical stiffness of the medium pressing member is weakened, and the medium pressing member is easily deformed. Therefore, in a case in which a force which floats the medium from the platen is strong, the medium pressing member is deformed due to the strong force, floating of the medium from the platen is difficult to be suppressed, and for example, there is a concern that jam of the medium may be generated. Further, if the medium pressing member is deformed, the medium pressing member is interfered with the head, and there is a concern that the head may malfunction.

SUMMARY

The invention can be realized in the following aspects or application examples.

Application Example 1

According to this application example, there is provided a printing apparatus including a medium supporting portion that supports a medium being transported in a transporting direction, a printing portion that performs printing on the medium in a printing region, a medium pressing member that is attached to the medium supporting portion and includes a plurality of materials stacked thereon, and a heating portion that heats the medium pressing member, the medium pressing member includes a base portion being attached to the medium supporting portion, and an eaves portion which forms a gap with the medium supporting portion and suppresses floating of the medium from the medium supporting portion, the base portion includes a first material for forming a first surface being attached to the medium supporting portion, and a second material for forming a second surface on an opposite side of the first surface, and a coefficient of thermal expansion of the first material is higher than a coefficient of thermal expansion of the second material.

The base portion of the medium pressing member in which the first material having the high coefficient of thermal expansion and the second material having the low coefficient of thermal expansion are sequentially stacked on the medium supporting portion are attached to (are fixed to) the medium supporting portion. When the medium pressing member is heated by the heating portion, the first material thermally extends more than the second material, and thus a force (hereinafter, refer to as deformation force) which deforms the end portion of the base portion in a direction of being separated from the medium supporting portion acts on the medium pressing member. Since the medium pressing member is fixed to the medium supporting portion, a force (Hereinafter, refer to as drag force) against the deformation force acts on the medium pressing member, and deformation of the medium pressing member is suppressed. The drag force is a force pressing the medium pressing member against the medium supporting portion. That is, when the medium pressing member is heated by the heating portion, the force pressing the medium pressing member against the medium supporting portion acts, and the medium pressing member becomes difficult to be deformed.

Therefore, even in a case in which the force applied from the medium, which deforms the medium pressing member, is strong, when the medium pressing member is heated by the heating portion, the force (drag force) pressing the medium pressing member against the medium supporting portion acts, the medium pressing member becomes difficult to be deformed, and the medium pressing member is capable of suppressing floating of the medium from the medium supporting portion. Further, if the medium pressing member becomes difficult to be deformed, a concern that the medium pressing member may be interfered with the printing portion and the printing portion may malfunction can be suppressed.

Application Example 2

In the printing apparatus according to the application example, it is preferable that the medium pressing member include an attaching portion for attaching the base portion to the medium supporting portion, and the attaching portion include a first attaching portion which is disposed on an upstream side of the printing region in the transporting direction, and a second attaching portion which is disposed on a downstream side of the printing region in the transporting direction.

The attaching portion attaching (fixing) the base portion to the medium supporting portion is disposed on both of an upstream side of the printing region in the transporting direction and a downstream side of the printing region in the transporting direction, and thus the medium pressing member becomes difficult to be deformed in the printing region.

Therefore, in the printing region, the medium pressing member is difficult to be deformed, floating of the medium from the medium supporting portion can be suppressed.

Application Example 3

In the printing apparatus according to the application example, it is preferable that the first material and the second material be metals.

If the first material and the second material are constituted of a metal, compared to a case of being constituted of a resin, heat or liquid resistance is increased, and thus the medium pressing member can be difficult to be deteriorated.

Application Example 4

In the printing apparatus according to the application example, it is preferable that the first material be a resin, and the second material be a metal.

The first material is a foundation on which the medium pressing member is attached to the medium supporting portion. If the first material is constituted of a resin, compared to a case of being constituted of a metal, for example, the first material is easily processed into a complicated shape by a molding process or the like. Therefore, even in a case in which the medium supporting portion has a complicated shape, the medium pressing member can be attached to the medium supporting portion having the complicated shape by processing the first material according to the complicated shape of the medium supporting portion.

Application Example 5

In the printing apparatus according to the application example, it is preferable that at least any one of the first material and the second material have elasticity, include a warp curved from a center portion toward an end portion so as to be separated from the medium supporting portion in a case in which the base portion is provided on the medium supporting portion, and be disposed along the medium supporting portion in a state in which the warp is corrected in a case in which the base portion is attached to the medium supporting portion.

In order to correct the warp which is curved so as to be separated from the medium supporting portion, a force correcting the curved warp needs to act on the medium pressing member. The force correcting the curved warp is a force pulling the medium pressing member to be close to the medium supporting portion, and a force pressing the medium pressing member against the medium supporting portion. Accordingly, when the medium pressing member is attached to the medium supporting portion in a state in which the curved warp to be separated from the medium supporting portion is corrected, the force pressing the medium pressing member against the medium supporting portion (force correcting the curved warp) acts on the medium pressing member.

Therefore, when the medium pressing member is heated by the heating portion, the force pressing the medium pressing member against the medium supporting portion (force correcting the curved warp) acts on the medium pressing member with the drag force, and thus the medium pressing member becomes more difficult to be deformed than a case in which only the drag force acts.

Application Example 6

In the printing apparatus according to the application example, it is preferable that at least any one of the first material and the second material be constituted of a shape memory alloy which memorizes a shape of the warp curved from the center portion toward the end portion so as to be separated from the medium supporting portion in a case of being heated by the heating portion.

In a case in which the medium pressing member is heated by the heating portion, from the center portion to the end portion, the medium pressing member (a shape memory alloy) is deformed in a curved warp so as to be separated from the medium supporting portion. In a case in which the medium pressing member is heated by the heating portion, since the medium pressing member is attached to the medium supporting portion in a state in which the curved warp shape is suppressed, a force suppressing the curved warp shape acts on the medium pressing member. The force suppressing the curved warp shape is a force pulling the medium pressing member to be close to the medium supporting portion, and the force pressing the medium pressing member against the medium supporting portion.

Therefore, in a case in which the medium pressing member is heated by the heating portion, the force pressing the medium pressing member against the medium supporting portion (force suppressing curved warp shape) acts on the medium pressing member with the drag force, and thus the medium pressing member becomes more difficult to be deformed than a case in which only the drag force acts.

Application Example 7

In the printing apparatus according to the application example, it is preferable that the heating portion be disposed on an opposite side of the medium pressing member of the medium supporting portion, and heat both the medium pressing member and the medium through the medium supporting portion.

Since the same heating portion heats both the medium pressing member and the medium, compared to a case in which different heating portions respectively heat the medium pressing member and the medium, the number of the heating portions can be reduced and low costs can be achieved.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, embodiments of the invention will be described with reference to drawings. Such embodiments indicate aspects of the invention, are not limited thereto, and can be arbitrarily changed within a range of a technical idea of the invention. In addition, in each of following drawings, since each layer or each part is set to have a size of a degree to be recognizable on the drawings, a scale of each layer or each part may be different from the actual scale.

Embodiment 1

Outline of Printing Apparatus

Figure 1:
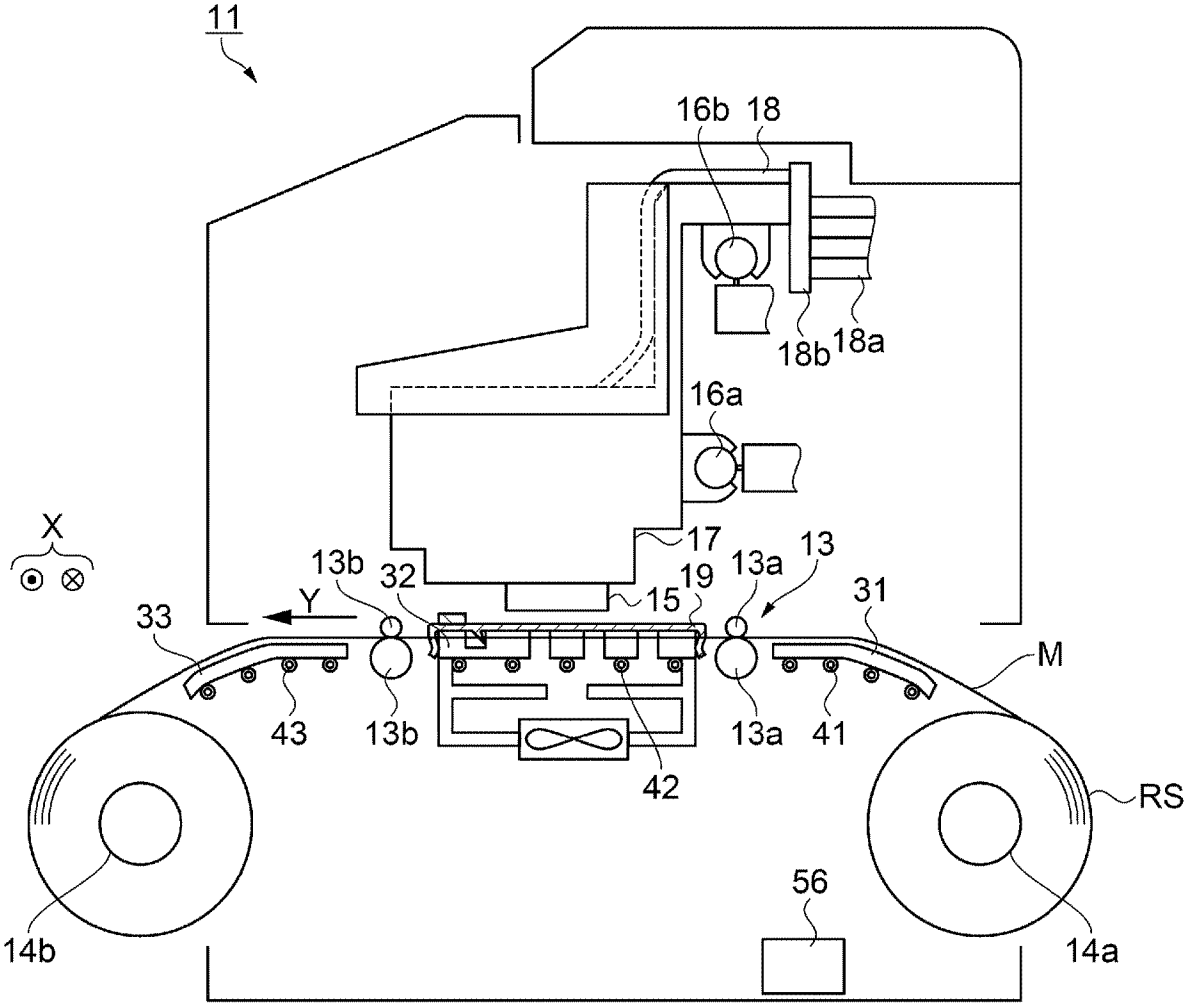
FIG. 1 is a schematic sectional view illustrating a schematic configuration of a printing apparatus according to Embodiment 1.
Figure 2:
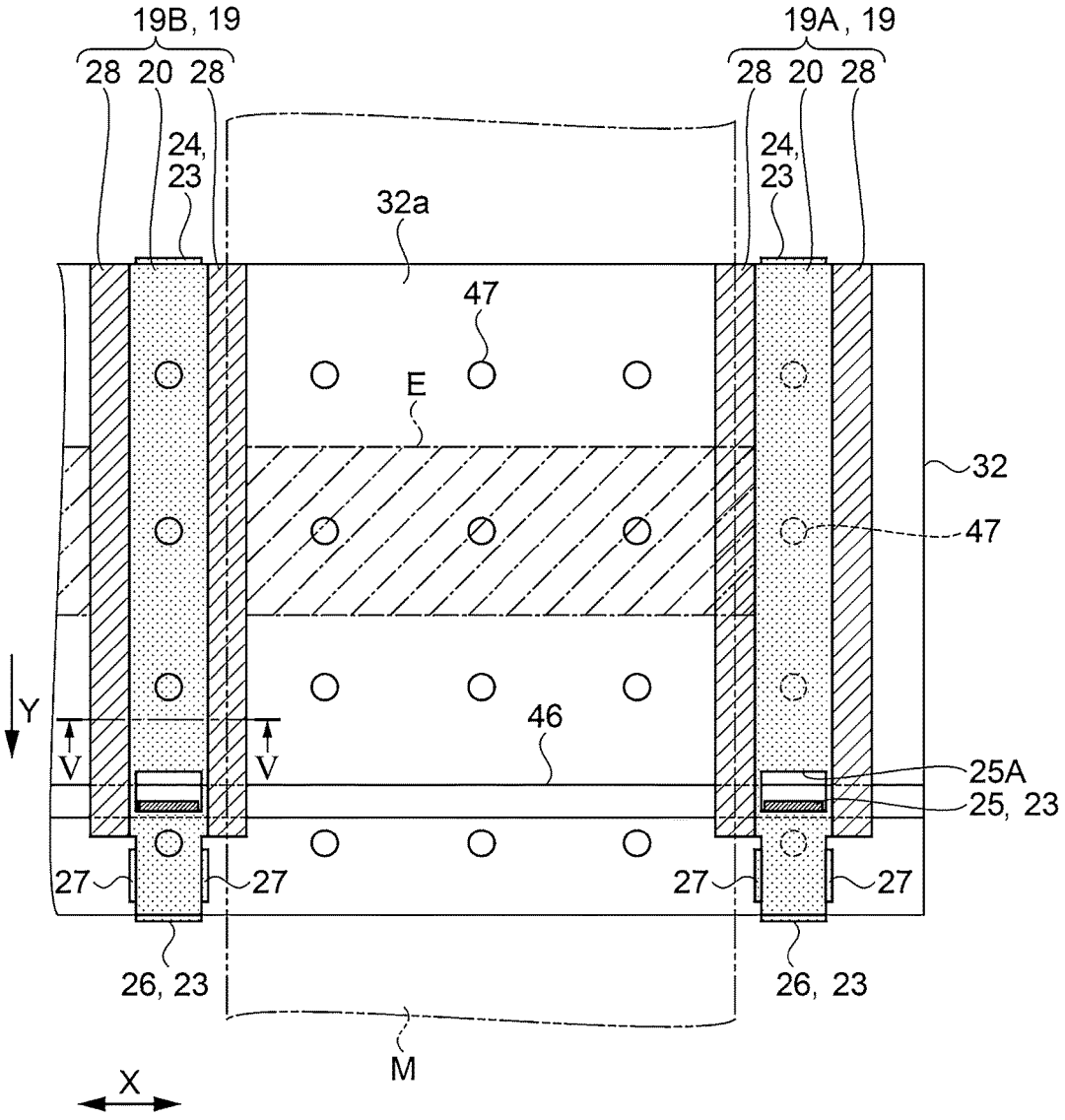
FIG. 2 is a schematic plan view illustrating vicinity where a medium supporting portion is disposed.
Figure 3:
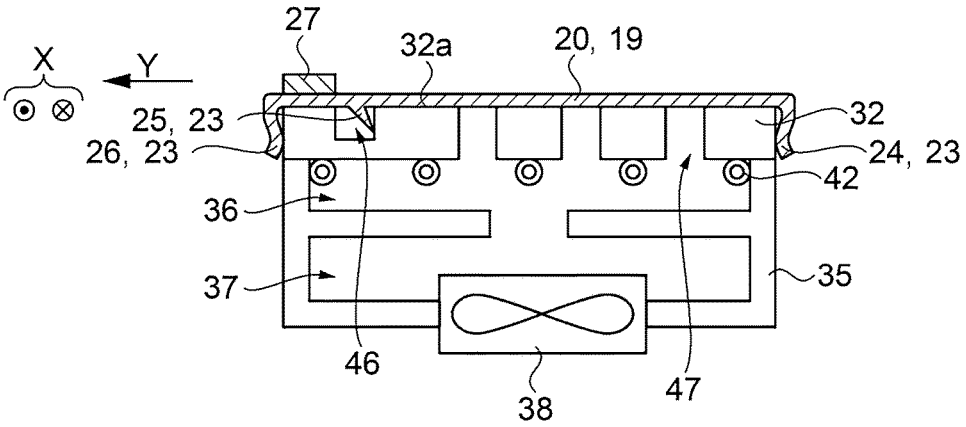
FIG. 3 is a schematic sectional view illustrating the vicinity where the medium supporting portion is disposed.
Figure 4:
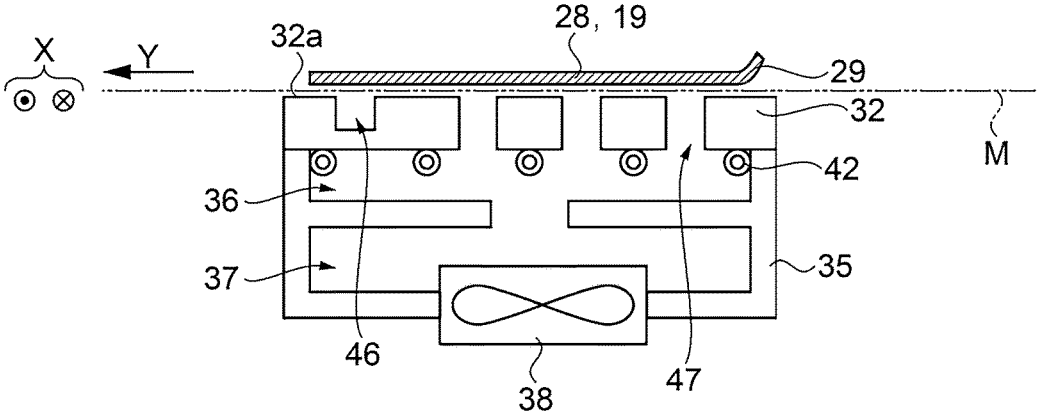
FIG. 4 is a schematic sectional view illustrating the vicinity where the medium supporting portion is disposed.

FIG. 1 is a schematic sectional view illustrating a schematic configuration of a printing apparatus according to Embodiment 1. FIG. 2 is a schematic plan view of vicinity where a medium supporting portion is disposed. FIGS. 3 and 4 are schematic sectional views of vicinity where the medium supporting portion is disposed.

Also, in FIGS. 1 to 4, description of unnecessary configuration components will be omitted. Further, in FIG. 2, a printing region E is illustrated by being hatched with a dashed line. The printing region E means a region where a head 15 which is an example of a "printing portion" is moved. FIG. 3 is a sectional view of a base portion 20 of a medium pressing member 19 taken along a transporting direction Y of a medium M, and is a view illustrating a state of the base portion 20 of the medium pressing member 19. FIG. 4 is a sectional view of a region, in which an eaves portion 28 of the medium pressing member 19 is disposed, taken along the transporting direction Y of the medium M, and is a view illustrating a state of the eaves portion 28 of the medium pressing member 19.

At first, an outline of a printing apparatus 11 according to the embodiment will be described with reference to FIGS. 1 to 3.

As illustrated in FIG. 1, the printing apparatus 11 according to the embodiment is a large format printer (LFP) handling a relatively large media (medium), and includes a medium supporting portion 32 which supports the medium M being transported in the transporting direction Y by a transporting portion 13, and a head 15 which is disposed on an opposite side of the medium supporting portion 32 with respect to the medium M and discharges ink.

Also, the head 15 is an example of a "printing portion performing printing on a medium in a printing region".

Further, an upstream side medium supporting portion 31 is disposed on an upstream side of the medium supporting portion 32 in the transporting direction Y, and a downstream side medium supporting portion 33 is disposed on a downstream side of the medium supporting portion 32 in the transporting direction Y. The medium M is supported by the upstream side medium supporting portion 31, the medium supporting portion 32, and the downstream side medium supporting portion 33, and is transported using the transporting portion 13 in the transporting direction Y illustrated by an arrow in the drawings.

The transporting portion 13 includes a pair of transporting rollers 13*a* and 13*b* in which one is driven by a driving source (not illustrated), and transports the medium M in the transporting direction Y by clipping and rotating the medium M. The pair of transporting rollers 13*a* is disposed on the upstream side of the medium supporting portion 32 in the transporting direction Y, and the pair of transporting rollers 13*b* is disposed on the downstream side of the medium supporting portion 32 in the transporting direction Y.

In the printing apparatus 11, the medium M is transported in a continuous form paper by being unwound from a roll of paper RS, which is wound around a supplying reel 14*a* in a roll shape. Also, ink is discharged from the head 15 to the medium M, and thus an image is printed on the medium M. The medium M on which the image is printed is wound around a winding reel 14*b* in a roll shape.

The head 15 is mounted in a carriage 17 which is movable in a width direction X while being able to slide and in contact with guide shafts 16*a* and 16*b* extending to the width direction X intersecting the transporting direction Y of the medium M. In detail, the head 15 is attached to the carriage 17 and is movable in the width direction X with the carriage 17, such that a nozzle forming surface, in which nozzles discharging ink to the medium M are formed, faces the medium supporting portion 32.

A ink supplying tube 18*a*, which can be deformed following the carriage 17 moving in the width direction X, is connected to a connecting tube 18 through a connecting portion 18*b* attached to a part of the carriage 17. The connecting tube 18 is connected to an ink flowing passage (not illustrated) provided inside the carriage 17. Ink accommodated in a liquid accommodating portion (not illustrated) is supplied to the head 15 through the ink supplying tube 18*a*, the connecting tube 18, and the ink flowing passage provided inside the carriage 17.

As illustrated in FIG. 2, the medium supporting portion 32 is provided with a supporting surface 32*a* having a substantially rectangular shape on a side facing the head 15 based on the width direction X of the medium M as a longitudinal direction, and the medium M is sucked and supported to the supporting surface 32*a* of the medium supporting portion 32. In the supporting surface 32*a* of the medium supporting portion 32, a groove portion 46 and a suction hole 47 are provided. The groove portion 46 extends in the width direction X.

The medium pressing member 19 is attached to the supporting surface 32*a* of the medium supporting portion 32. Details thereof will be described later, but the medium pressing member 19 is attached to the medium supporting portion 32, and has a configuration in which a plurality of materials (first material 21 (refer to FIG. 5) and second material 22 (refer to FIG. 5)) are stacked.

The medium pressing member 19 is a member (elongated member) which is long in the transporting direction Y and is formed by a half-blanking process or a bending process. The medium pressing member 19 is configured with a first medium pressing member 19A disposed on a right side in the drawing and a second medium pressing member 19B disposed on a left side in the drawing. The first medium pressing member 19A and the second medium pressing member 19B are a member having the same shape as each other. In description hereinafter, the first medium pressing member 19A and the second medium pressing member 19B may be simply referred to as the medium pressing member 19.

As illustrated in FIG. 3, a suction chamber forming member 35 is assembled with a lower portion of the medium supporting portion 32. Also, a negative pressure chamber 36 is formed by the medium supporting portion 32 and the suction chamber forming member 35. The suction hole 47 described above penetrates through the medium supporting portion 32 and communicates with the negative pressure chamber 36 formed on the lower portion of the medium supporting portion 32.

The suction chamber forming member 35 includes a suction chamber 37 communicating with the negative pressure chamber 36, and an exhaust fan 38 discharging air in the suction chamber 37 to the outside. When the exhaust fan 38 is driven, the air in the suction chamber 37 is discharged to the outside, the suction chamber 37 becomes negatively pressurized, the negative pressure chamber 36 communicating with the suction chamber 37 also becomes negatively pressurized. The medium M is sucked and supported by the supporting surface 32*a* of the medium supporting portion 32 through the suction hole 47 communicating with the negative pressure chamber 36.

In the printing apparatus 11, when an image is printed on the medium M by discharging ink from the head 15, the exhaust fan 38 is driven, the suction chamber 37 and the negative pressure chamber 36 are negatively pressurized, and the medium M is sucked and supported by the supporting surface 32*a* of the medium supporting portion 32 through the suction hole 47.

Return to FIG. 1, heaters 41, 42, and 43 are respectively attached to the upstream side medium supporting portion 31, the medium supporting portion 32, and the downstream side medium supporting portion 33. The heaters 41, 42, and 43, for example, are a tube heater, and are respectively attached to a lower surface (surface opposite to surface supporting medium M) of the upstream side medium supporting portion 31, the medium supporting portion 32, and the downstream side medium supporting portion 33 through an aluminum tape or the like. Also, when a power source portion 56 supplies power to the heaters 41, 42, and 43, the medium M can be heated from a rear side of the medium M.

For example, temperatures of a pre-heater 41 and a platen heater 42 are set to approximately 40° C., and a temperature of the after-heater 43 is set to approximately 50° C. higher than the temperature of the pre-heater 41 or the platen heater 42.

Also, the platen heater 42 is an example of a "heating portion".

The pre-heater 41 gradually increases the temperature of the medium M from a room temperature up to a heating temperature (approximately 40° C.) of the platen heater 42 through the upstream side medium supporting portion 31. The platen heater 42 is disposed on an opposite side of the medium pressing member 19 of the medium supporting portion 32, heats both the medium pressing member 19 and the medium M through the medium supporting portion 32, and quickly dries ink landed on the medium M. The after-heater 43 increases the temperature of the medium M up to a temperature (approximately 50° C.) higher than a heating temperature (approximately 40° C.) of the platen heater 42 through the downstream side medium supporting portion 33, and completely dries the ink landed on the medium M to be fixed to the medium M before the medium M is wound around the winding reel 14*b*.

When the carriage 17 moves (reciprocates and moves) in the width direction X of the medium M, the ink is discharged from the head 15 with respect to the medium M sucked and supported by the medium supporting portion 32, the printing apparatus 11 having such a configuration prints an image including letters, figures, and the like on the medium M by alternatively repeating a liquid discharging operation in which the head 15 discharges the ink while moving in the width direction X and a transporting operation in which the medium M is transported in the transporting direction Y by the transporting portion 13.

Medium Pressing Member

Next, with reference to FIG. 2 to FIG. 4, the medium pressing member 19 will be described in detail.

The medium pressing member 19 is a member, which is attached to the supporting surface 32*a* of the medium supporting portion 32 and suppresses floating of the medium M from the medium supporting portion 32, and forms an gap with the medium supporting portions 32 on which an end portion of the medium M is disposed. The medium pressing member 19 is disposed between the head 15 and the medium supporting portion 32, and between the head 15 and the medium M.

The medium pressing member 19 is disposed so as to be in contact (interfered) with the head 15 in a case in which the head 15 mounted in the carriage 17 moves in the width direction X. That is, the medium pressing member 19 is disposed so as to be interfered with the head 15 in a case in which the head 15 moves in the printing region E.

An interval between the medium supporting portion 32 and the head 15 is approximately 1.5 mm to 2.0 mm. A thickness of the medium M is approximately 0.5 mm or less. Since the medium pressing member 19 is disposed between the head 15 and the medium M, in order to make the medium pressing member 19 not interfere with the head 15, a thickness of the medium pressing member 19 is preferably 1 mm or less, and more preferably, 0.5 mm or less in consideration of a tolerance of each member.

As illustrated in FIG. 2, the medium pressing member 19 has a longer shape in the transporting direction Y than the width direction X, and is a thin elongated member having a thickness of 1 mm or less. The medium pressing member 19 includes the base portion 20 being disposed on the center and eaves portions 28 being disposed on both ends of the base portion 20. That is, in the medium pressing member 19, one eaves portion 28, the base portion 20, and another eaves portion 28 are sequentially disposed along the width direction X.

Further, the base portion 20 protrudes to a downstream side of the eaves portion 28 in the transporting direction Y. A knob portion 27 is formed on both end sides of a part protruding to the downstream side of the base portion 20 in the transporting direction Y. A user can grab the knob portion 27, and moves (slides) the medium pressing member 19 in an extending direction (width direction X) of the groove portion 46.

In plan view, the end portion of the medium M is disposed on a part in which the eaves portion 28 and the medium supporting portion 32 overlap with each other (gap between eaves portion 28 and medium supporting portion 32).

The medium M has various sizes, and the medium M includes various widths (length of width direction X). In a case in which the mediums M having different sizes are set, a position of the first medium pressing member 19A is fixed, a position of the second medium pressing member 19B is moved in the width direction X, and an interval between the first medium pressing member 19A and the second medium pressing member 19B is adjusted.

As illustrated in FIGS. 2 and 3, the base portion 20 of the medium pressing member 19 is disposed so as to be in contact with the supporting surface 32*a* of the medium supporting portion 32, and is attached to (is fixed to) the medium supporting portion 32 by the attaching portion 23.

The attaching portion 23 includes a first attaching portion 24 which is disposed on a upstream side of the printing region E in the transporting direction Y, and a second attaching portion 25 and the third attaching portion 26 which are disposed on the downstream side of the printing region E in the transporting direction Y. That is, the base portion 20 includes the first attaching portion 24, the second attaching portion 25, and the third attaching portion 26 which are sequentially disposed along the transporting direction Y. In other words, the medium pressing member 19 includes at least two attaching portions 23 which attach the base portion 20 to the medium supporting portion 32.

Also, the attaching portion 23 may be configured to be disposed on both the upstream side of the printing region E in the transporting direction Y and the downstream side of the printing region E in the transporting direction Y with respect to, for example, may be configured not to have the third attaching portion 26, for example, may be configured not to have the second attaching portion 25, or may be configured so that an attaching portion other than the attaching portions 24, 25, and 26 are attached.

The first attaching portion 24 is formed by bending the end portions of the upstream side of the base portion 20 in the transporting direction Y. The first attaching portion 24 is attached so as to grab the end portions of the upstream side (wall surface of medium supporting portion 32) of the medium supporting portion 32 in the transporting direction Y, and protrudes from the end portion of the medium supporting portion 32 in a plan view.

The base portion 20 is constituted of a material having elasticity. The first attaching portion 24 is a type of a spring member which is elastically deformed. When the first attaching portion 24 grabs the end portions of the upstream side of the medium supporting portion 32 in the transporting direction Y in a state of being elastically deformed, an upstream side of the base portion 20 with respect to the printing region E is fixed to the medium supporting portion 32.

The second attaching portion 25 is formed by cutting a part of the base portion 20 and bending the cut part. Further, an opening 25A is formed with the second attaching portion 25 by cutting the part of the base portion 20. As a result, the opening 25A and the second attaching portion 25 are formed on the downstream side of the printing region E in the transporting direction.

The second attaching portion 25 is a type of a spring member which is elastically deformed, and is fitted into an intermediate of the groove portion 46 of the medium supporting portion 32. When the second attaching portion 25 grabs a wall surface of the medium supporting portion 32 in the groove portion 46 in a state of being elastically deformed, a downstream side of the base portion 20 with respect to the printing region E is fixed to the medium supporting portion 32.

Since the medium pressing member 19 moves in the width direction X in a state in which the second attaching portion 25 is fitted into an intermediate of the groove portion 46, the second attaching portion 25 has a function of guiding movement of the medium pressing member 19 in the width direction X.

The third attaching portions 26 are formed by bending both end portions on the downstream side of the base portion 20 in the transporting direction Y. The third attaching portions 26 are respectively attached so as to grab both the end portions of the downstream side of the medium supporting portion 32 (wall surface of medium supporting portion 32) in the transporting direction Y, and protrudes from the end portions of the medium supporting portion 32 in a plan view.

The third attaching portion 26 is a type of a spring member which is elastically deformed. When the third attaching portion 26 grabs both the end portions of the downstream side of the medium supporting portion 32 in the transporting direction Y in a state of being elastically deformed, a downstream side of the base portion 20 with respect to the printing region E is fixed to the medium supporting portion 32.

In addition, after a position of the medium pressing member 19 with respect to the medium supporting portion 32 is adjusted so that the second attaching portion 25 is disposed on the intermediate of the groove portion 46, when the medium pressing member 19 is pushed into the medium supporting portion 32, the attaching portions 24, 25, and 26 are elastically deformed, the wall surface of the medium supporting portion 32 is grabbed, and the medium pressing member 19 can be attached (fixed) to the medium supporting portion 32.

As illustrated in FIG. 4, a gap is formed between the eaves portion 28 of the medium pressing member 19 and the medium supporting portion 32. An end portion of the medium M is disposed on a gap between the eaves portion 28 and the medium supporting portion 32. Further, an inclined portion 29 separated from the medium supporting portion 32 toward the upstream side in the transporting direction Y is formed on an upstream side end in the transporting direction Y in the eaves portion 28.

The medium M is unwound from the roll of paper RS in a state of being wound around the supplying reel 14*a*, and is transported in the transporting direction Y by the transporting portion 13. The medium M is easily warped (easily floats) in a direction of being separated from the medium supporting portion 32 by a winding curl of the roll of paper RS which is wound in a roll state. Even in a case in which the medium M is warped by the winding curl, since a distal end of the medium M is guided to the gap between the medium supporting portion 32 and the eaves portion 28 by the inclined portion 29, the medium M stably passes through the gap between the medium supporting portion 32 and the eaves portion 28.

If the medium M floats from the medium supporting portion 32 and passes over the medium pressing member 19, there is a concern of a defect of interfering the medium M with the head 15 or a defect such as jam of the medium M. The inclined portion 29 suppresses such a defect.

The eaves portion 28 presses the end portion of the medium M between the medium supporting portion 32 and the eaves portion in a case in which the medium M floats from the medium supporting portion 32 by the winding curl, and suppresses floating of the medium M from the medium supporting portion 32. As a result, a defect, of which the medium M floats from the medium supporting portion 32 by the winding curl, is close to the head 15, and is interfered with the head 15, and the head 15 malfunctions, is suppressed. Further, the defect such as jam of the medium M can be also suppressed.

In order to increase a printing speed of the printing apparatus 11, it is necessary to increase the head 15 in size and to lengthen a dimension of the transporting direction Y of the head 15. Therefore, a length of the transporting direction Y of the medium pressing member 19 needs to be longer. Further, since the printing apparatus 11 deals with relatively large media (medium), compared to a case of dealing with small media (medium), the medium pressing member becomes greater and the length of the transporting direction Y of the medium pressing member 19 becomes longer.

However, when the medium pressing member 19 is lengthened, the medium pressing member 19 is easily deformed due to small force, compared to a case in which the medium pressing member 19 is short. Further, since the medium pressing member 19 is a thin elongated member, the medium pressing member 19 is easily deformed due to small force, compared to a case in which the medium pressing member 19 is a thick elongated member.

For example, in order to make the medium pressing member 19 be difficult to be deformed, it is considered that the medium pressing member 19 is thickened. However, if the medium pressing member 19 becomes thickened, the interval between the medium supporting portion 32 and the head 15 is lengthened, a flight distance of ink being discharged from the head 15 to the medium M is lengthened, the ink being discharged from the head 15 is difficult to be landed on a target position of the medium M, and a quality of the image being printed on the medium M may be deteriorated.

Therefore, in order to suppress deterioration of the quality of the image being printed on the medium M, the interval between the medium supporting portion 32 and the head 15 is preferably short, the medium pressing member 19 is preferably thin, and the medium pressing member 19 is easily deformed due to small force.

Meanwhile, if a force from the medium supporting portion 32 toward the head 15 acts on the medium pressing member 19 from the medium M by the winding curl of the roll of paper RS, the medium pressing member 19 is easily deformed from the medium supporting portion 32 toward the head 15. If the medium pressing member 19 is deformed toward the head 15, is close to the head 15, and is interfered with the head 15, there is a concern that the head 15 may malfunction.

Further, if the medium pressing member 19 is deformed from the medium supporting portion 32 toward the head 15, the medium M is also deformed from the medium supporting portion 32 toward the head 15, an interval between the head 15 and the medium M becomes not uniformed, there is a concern that the defect of deteriorating a quality of the image being printed on the medium M may generated. Further, there is a concern that the defect such as jam of the medium M may be generated.

As seen from the above, since, in the printing apparatus 11 dealing with relatively large media (medium), the length of the medium pressing member 19 becomes longer and is easily deformed, compared to a case of dealing with small media (medium), various defects are easily generated such as a defect such as malfunction of the head 15, a defect such as deterioration of the quality of the image being printed on the medium M, or the defect such as jam of the medium M.

In the embodiment, even in a case in which the medium pressing member 19 becomes greater and the medium pressing member 19 is lengthened, an excellent configuration is provided in which the medium pressing member 19 is difficult to be deformed, the defects described above are not difficult to be generated, and long term reliability or a printing quality of the printing apparatus 11 dealing with relatively large media (medium) can be increased.

Hereinafter, details will be described.

Figure 5:
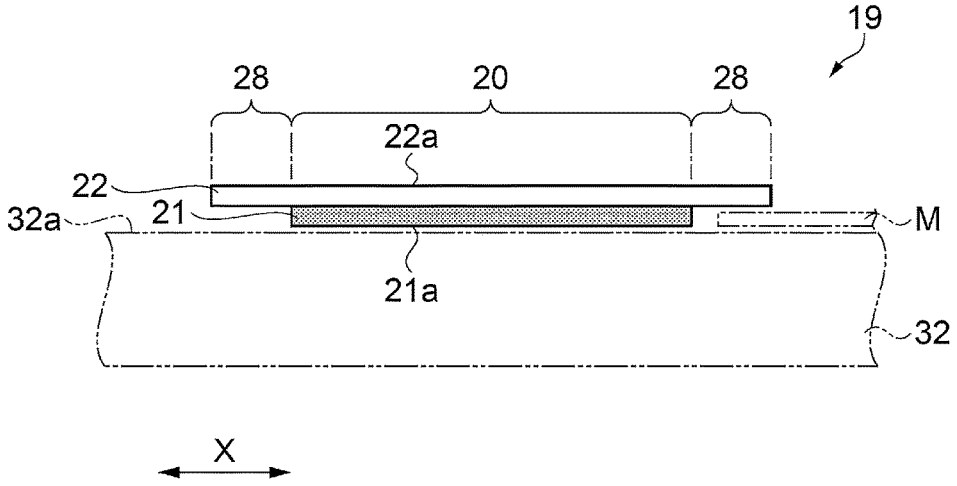
FIG. 5 is a schematic sectional view of a medium pressing member taken along V-V line of FIG. 2.
Figure 6:
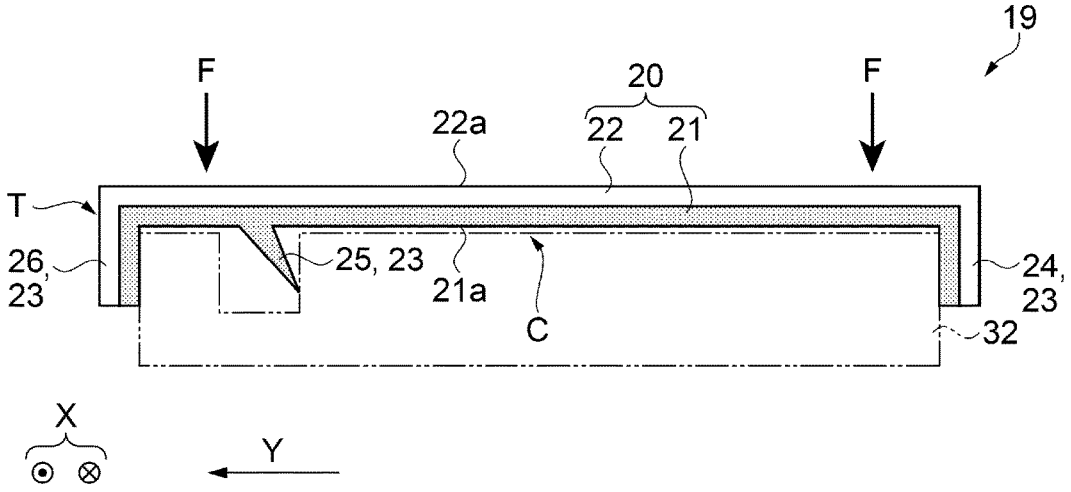
FIG. 6 is a schematic sectional view illustrating a state of a base portion of the medium pressing member according to Embodiment 1.
Figure 7A:
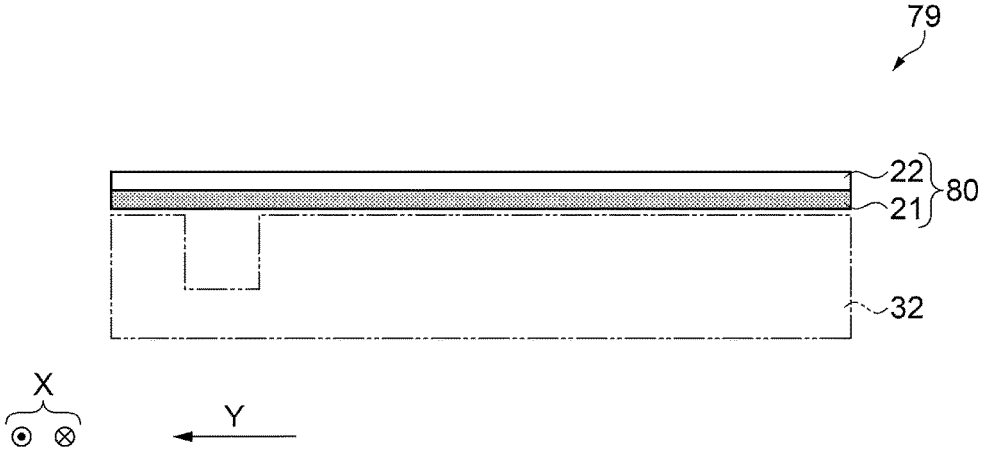
FIG. 7A is a schematic sectional view illustrating a state of a base portion of a medium pressing member according to a comparison example.
Figure 7B:
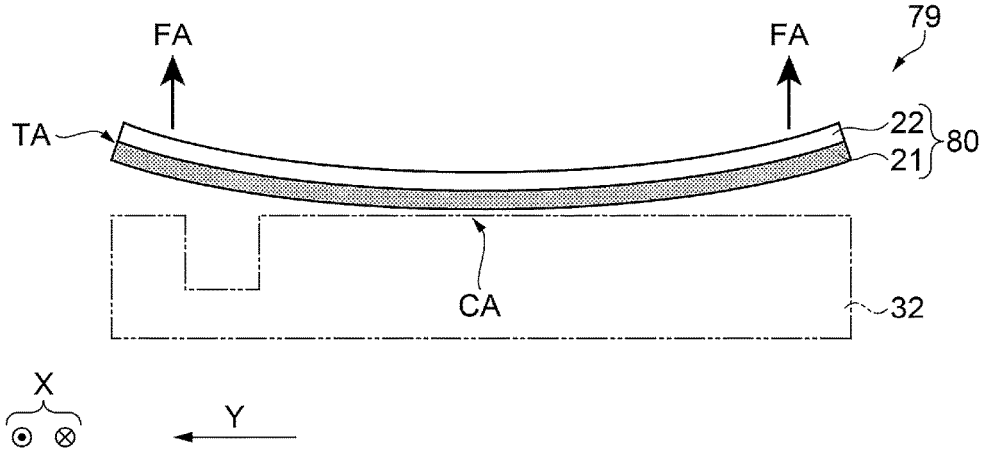
FIG. 7B is a schematic sectional view illustrating the state of the base portion of the medium pressing member according to the comparison example.

FIG. 5 is a schematic sectional view of the medium pressing member taken along V-V line of FIG. 2. FIG. 6 is a view corresponding to FIG. 3, and is a schematic sectional view illustrating a state of the base portion of the medium pressing member according to the embodiment. FIGS. 7A and 7B are views corresponding to FIG. 6, and are schematic sectional views illustrating the state of the base portion of the medium pressing member according to a comparison example.

In addition, FIG. 7A illustrates a state of a base portion 80 of a medium pressing member 79 according to a comparison example in a case in which heating is not performed by the platen heater 42. FIG. 7B illustrates a state of the base portion 80 of the medium pressing member 79 according to the comparison example in a case in which heating is performed by the platen heater 42.

As illustrated in FIG. 5, the medium pressing member 19 includes the first material 21 and the second material 22 which are sequentially stacked on the medium supporting portion 32.

The first material 21 is attached to the supporting surface 32*a* of the medium supporting portion 32, and forms a first surface 21*a* in contact with the medium supporting portion 32. The first material 21 is constituted of stainless steel for spring (SUS 304). A coefficient of thermal expansion of the first material 21 is approximately $17.3\times10^{-6}$° C.$^{-1}$. The first material 21 is formed by performing a bending process on a base material constituted of the SUS 304.

The second material 22 is disposed on an opposite side of the medium supporting portion 32 of the first material 21, and forms a second surface 22*a* on an opposite side of the first surface 21*a*. The second material 22 is constituted of stainless steel for spring (SUS 301). A coefficient of thermal expansion of the second material 22 is approximately $16.9\times10^{-6}$° C.$^{-1}$. The second material 22 is formed by performing the bending process on a base material constituted of the SUS 301.

Further, the second material 22 is bonded to the first material 21 through an adhesive (not illustrated). Also, the second material 22 may be directly bonded to the first material 21 by a method such as friction welding.

The first material 21 and the second material 22 are a so-called spring plate, and have elasticity. The first material 21 and the second material 22 are constituted of a metal having excellence corrosion resistance, and are difficult to be deteriorated by a chemical solution (for example, ink) or heat, and thus reliability of the medium pressing member 19 can be increased.

In the width direction X, the second material 22 protrudes from the first material 21. A part of the second material 22 protruding from the first material 21 becomes the eaves portion 28 which forms a gap with the medium supporting portion 32. The end portion of the medium M is disposed on a gap between the part (eaves portion 28) of the second material 22 protruding from the first material 21 and the medium supporting portion 32.

As described above, the eaves portion 28 of the medium pressing member 19 is constituted of the second material 22, forms the gap with the medium supporting portion 32, and suppresses floating of the medium M from the medium supporting portion 32.

Meanwhile, a part on which the first material 21 and the second material 22 are stacked becomes the base portion 20 of the medium pressing member 19. That is, in the base portion 20 being attached to the medium supporting portion 32, the first material 21 constituting the first surface 21*a* being attached to the medium supporting portion 32 and the second material 22 constituting the second surface 22*a* on an opposite side of the first surface 21*a* are sequentially stacked, and the coefficient of thermal expansion of the first material 21 becomes higher than the coefficient of thermal expansion of the second material 22.

As seen from the above, the base portion 20 of the medium pressing member 19 includes a configuration in which the first material 21 having a high coefficient of thermal expansion and the second material 22 having a low coefficient of thermal expansion are sequentially stacked on the medium supporting portion 32.

As illustrated in FIG. 7A, the base portion 80 of the medium pressing member 79 according to the comparison example has a same point as that of Embodiment 1, in terms of the fact that the first material 21 having the high coefficient of thermal expansion and the second material 22 having the low coefficient of thermal expansion are sequentially stacked on the medium supporting portion 32. Meanwhile, the comparison example has a different point from Embodiment 1 in terms of the fact that the base portion 80 of the medium pressing member 79 does not include the attaching portion and is not fixed to the medium supporting portion 32.

Further, the comparison example has the same point as Embodiment 1 in terms of the fact that the base portion 80 of the medium pressing member 79 is disposed along the transporting direction Y without acting extra force in a case of not being heated by the platen heater 42 (in a case of being positioned at room temperature).

As illustrated in FIG. 7B, when the medium pressing member 79 is heated by the platen heater 42, the coefficient of thermal expansion of the first material 21 becomes higher than the coefficient of thermal expansion of the second material 22, and thus the first material 21 thermally expands more than the second material 22. Then, the base portion 80 of the medium pressing member 79 is not fixed to the medium supporting portion 32, and thus is curved (deformed) so as to be separated from the medium supporting portion 32, from the center portion CA toward the end portion TA. In other words, when the medium pressing member 79 is heated by the platen heater 42, a force FA (force illustrated by arrow in drawing) deforming the end portion TA in a direction of being separated from the medium supporting portion 32 acts on the base portion 80 of the medium pressing member 79, and thus the end portion TA of the base portion 80 of the medium pressing member 79 is deformed in a direction of being separated from the medium supporting portion 32.

In the following description, the force FA deforming the end portion TA in the direction of being separated from the medium supporting portion 32 is referred to as a deformation force FA.

Meanwhile, it is not illustrated, but in a case in which the coefficient of thermal expansion of the first material 21 is lower than the coefficient of thermal expansion of the second material 22, when the medium pressing member 79 is heated, the base portion 80 of the medium pressing member 79 is deformed in a shape opposite to that of in FIG. 7B. In detail, a force, which increases from the end portion TA toward the center portion CA, deforming the end portion TA in the direction of being separated from the medium supporting portion 32 acts on the base portion 80 of the medium pressing member 79, and thus the center portion CA of the base portion 80 of the medium pressing member 79 is deformed in a direction of being separated from the medium supporting portion 32.

As illustrated in FIG. 6, the base portion 20 of the medium pressing member 19 according to the embodiment is disposed along the transporting direction Y without acting extra force in a case of not being heated by the platen heater 42 (in a case of being positioned at room temperature).

When the medium pressing member 19 is heated by the platen heater 42, since the coefficient of thermal expansion of the first material 21 is higher than the coefficient of thermal expansion of the second material 22, the first material 21 thermally expands more than the second material 22, and the deformation force FA (refer to FIG. 7B) described above acts on the base portion 20 of the medium pressing member 19. That is, the deformation force FA, which increases from the center portion C toward the end portion T, deforming in the direction of being separated from the medium supporting portion 32 acts on the base portion 20 of the medium pressing member 19.

However, since the end portion T of the base portion 20 of the medium pressing member 19 is fixed to the medium supporting portion 32 by the attaching portion 23, even when the deformation force FA acts on the base portion 20 of the medium pressing member 19, deformation of the base portion 20 of the medium pressing member 19 is suppressed. That is, as illustrated in FIG. 6, a force F (hereinafter, refer to drag force F) against the deformation force FA acts on the base portion 20 of the medium pressing member 19, and deformation of the base portion 20 of the medium pressing member 19 is suppressed.

The drag force F is a force pressing the medium pressing member 19 against the medium supporting portion 32 and suppresses deformation of the medium pressing member 19. Therefore, when the medium pressing member 19 is heated by the platen heater 42, the base portion 20 of the medium pressing member 19 becomes in a state of being pressed by the drag force F against the medium supporting portion 32, and is difficult to be deformed.

Meanwhile, it is not illustrated, but in a case in which the coefficient of thermal expansion of the first material 21 is lower than the coefficient of thermal expansion of the second material 22, if the medium pressing member 19 is heated, the force, which increases the end portion T toward the center portion C, deforming in the direction of being separated from the medium supporting portion 32 acts on the base portion 20 of the medium pressing member 19. In this case, the center portion C of the base portion 20 of the medium pressing member 19 is not fixed to the medium supporting portion 32, and thus is deformed in the direction of being separated from the medium supporting portion 32. Further, when the center portion C of the base portion 20 of the medium pressing member 19 is deformed in the direction of being separated from the medium supporting portion 32, and is close to the head 15, there is a concern that the head 15 may be interfered and the head 15 may malfunction.

As seen from the above, when the medium pressing member 19 is heated by the platen heater 42, in a configuration in which the coefficient of thermal expansion of the first material 21 is lower than the coefficient of thermal expansion of the second material 22, the medium pressing member 19 is deformed, but in a configuration in which the coefficient of thermal expansion of the first material 21 is higher than the coefficient of thermal expansion of the second material 22, the medium pressing member 19 is difficult to be deformed. Therefore, in order to make the medium pressing member 19 be difficult to be deformed, it is preferable that the coefficient of thermal expansion of the first material 21 be higher than the coefficient of thermal expansion of the second material 22.

As described above, when the coefficient of thermal expansion of the first material 21 is higher than the coefficient of thermal expansion of the second material 22, and the medium pressing member 19 is heated by the platen heater 42, the medium pressing member 19 becomes in a state of being pressed against the medium supporting portion 32 due to the drag force F, and the medium pressing member 19 is difficult to be deformed. Therefore, even when the medium pressing member 19 is increased in size and the medium pressing member 19 is lengthened, the medium pressing member 19 according to the embodiment is difficult to be deformed, and thereby making it possible to increase long term reliability or a printing quality of the printing apparatus 11.

Embodiment 2

Figure 8:
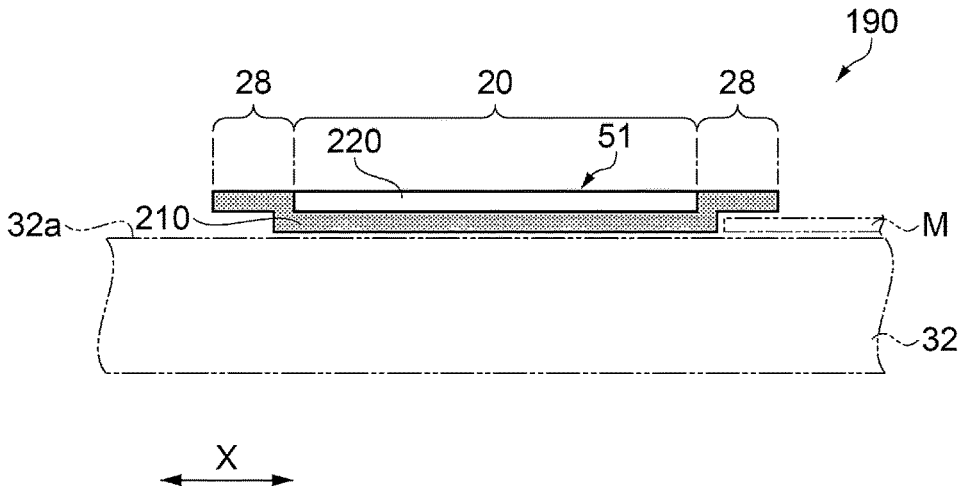
FIG. 8 is a schematic sectional view illustrating a medium pressing member mounted on a printing apparatus according to Embodiment 2.

FIG. 8 is a view corresponding to FIG. 5, and is a schematic sectional view of the medium pressing member mounted in the printing apparatus according to Embodiment 2.

A medium pressing member 190 according to the embodiment is different from the medium pressing member 19 according to Embodiment 1 in terms of the shapes thereof, and the different point is a main difference between Embodiment 1 and Embodiment 2.

Hereinafter, refer to FIG. 8, the medium pressing member 190 mounted in the printing apparatus according to the embodiment will be described based on a difference from Embodiment 1. In addition, the same numeral is given to the same configuration part as that of Embodiment 1, and overlapping description will be omitted.

As described above FIG. 8, in the printing apparatus according to the embodiment, the medium pressing member 190 is attached to the supporting surface 32*a* of the medium supporting portion 32, and a first material 210 and a second material 220 are sequentially stacked on the medium supporting portion 32.

The first material 210 is constituted of the same material (SUS 304) as the first material 21 of Embodiment 1, and has elasticity. A coefficient of thermal expansion of the first material 210 is approximately $17.3\times10^{-6}$° C.$^{-1}$. The second material 220 is constituted of the same material (SUS 301) as the second material 22 of Embodiment 1, and has elasticity. The coefficient of thermal expansion of the second material 220 is approximately $16.9\times10^{-6}$° C.$^{-1}$.

The coefficient of thermal expansion of the first material 210 is higher than the coefficient of thermal expansion of the second material 220.

The first material 210 is formed by performing a bending process on a base material constituted of the SUS 304, and includes a recessed portion 51 in which the center portion is recessed compared to the end portion. That is, the first material 210 includes the recessed portion 51 and a part protruding from the recessed portion 51 in the width direction X. The second material 220 is fitted into the recessed portion 51.

The part protruding from the recessed portion 51 of the first material 210 in the width direction X becomes the eaves portion 28 and forms the gap with the medium supporting portion 32. Therefore, the eaves portion 28 of the embodiment is constituted of the first material 210, the eaves portion 28 of Embodiment 1 is constituted of the second material 22, and this point is a difference between the embodiment and Embodiment 1.

A part in which the first material 210 and the second material 220 are stacked on the medium supporting portion 32 becomes the base portion 20. The base portion 20 of the embodiment has a configuration in which the first material 210 having the high coefficient of thermal expansion and the second material 220 having the low coefficient of thermal expansion are sequentially stacked on the medium supporting portion 32, and this point is the same as Embodiment 1.

Even with the above configuration, since the base portion 20 of the medium pressing member 190 according to the embodiment is the same as Embodiment 1, the same effect as that of Embodiment 1 can be obtained in which, when the medium pressing member 190 is heated by the platen heater 42, the base portion 20 of the medium pressing member 190 becomes in a state of being pressed against the medium supporting portion 32 by the drag force F, and thus the medium pressing member 190 is difficult to be deformed.

The invention is not limited to the above-described embodiments, can be appropriately modified within a range not contrary to the gist or idea of the invention which can be read from claims and the entire specification, and various modification examples are conceivable besides the embodiments described above.

Modification Example 1

A medium pressing member 19Z (not illustrated) according to Modification Example 1 is different from the medium pressing member 19 according to Embodiment 1 in terms of a material constituting the first material 21.

Hereinafter, the same numeral is given to the same configuration part as that of Embodiment 1, and this modification example will be described based on a difference from Embodiment 1.

The first material 21 of the medium pressing member 19Z according to the modification example is constituted of a resin (for example, polyacetal resin (POM resin)). The first material 21 is formed by performing a molding process on the POM resin, and the coefficient of thermal expansion of the first material 21 is approximately $100\times10^{-6}$° C.$^{-1}$.

The second material 22 is constituted of stainless steel for spring (SUS 301). The coefficient of thermal expansion of the second material 22 is approximately $16.9\times10^{-6}$° C.$^{-1}$.

As seen from the above, in the modification example, the first material 21 is constituted of a resin, and the second material 22 is constituted of a metal. Meanwhile, in Embodiment 1, both of the first material 21 and the second material 22 are constituted of a metal. This point is a difference between the modification example and Embodiment 1.

Since the base portion 20 of the medium pressing member 19Z according to the modification example is the same as Embodiment 1, the same effect as that of Embodiment 1 can be obtained in which, when the first material 21 having the high coefficient of thermal expansion and the second material 22 having the low coefficient of thermal expansion are sequentially stacked on the medium supporting portion 32, and the medium pressing member 19Z is heated by the platen heater 42, the base portion 20 of the medium pressing member 19Z becomes in a state of being pressed against the medium supporting portion 32 by the drag force F, and thus the medium pressing member 19 Z is difficult to be deformed.

Further, when the first material 21 is formed by performing the molding process on the resin (POM resin), the first material can be processed so as to have more complicated shape than a case in which the first material 21 is formed by performing the bending process on a metal (Embodiment 1). As a result, regarding a part to which the first material 21 is difficult to be attached in Embodiment 1, the first material 21 of the modification example can be attached thereto. That is, in the modification example, compared to Embodiment 1, a degree of freedom of the part to which the first material 21 is attached can be increased.

Further, since the medium pressing member 19Z according to the modification example is constituted of a resin (POM resin) and a metal (stainless steel for spring), costs can be reduced compared to a case in which the entire medium pressing member is constituted of a metal (stainless steel for spring) (Embodiment 1).

Further, the modification example may be applied to the medium pressing member 190 according to Embodiment 2.

Modification Example 2

Figure 9:
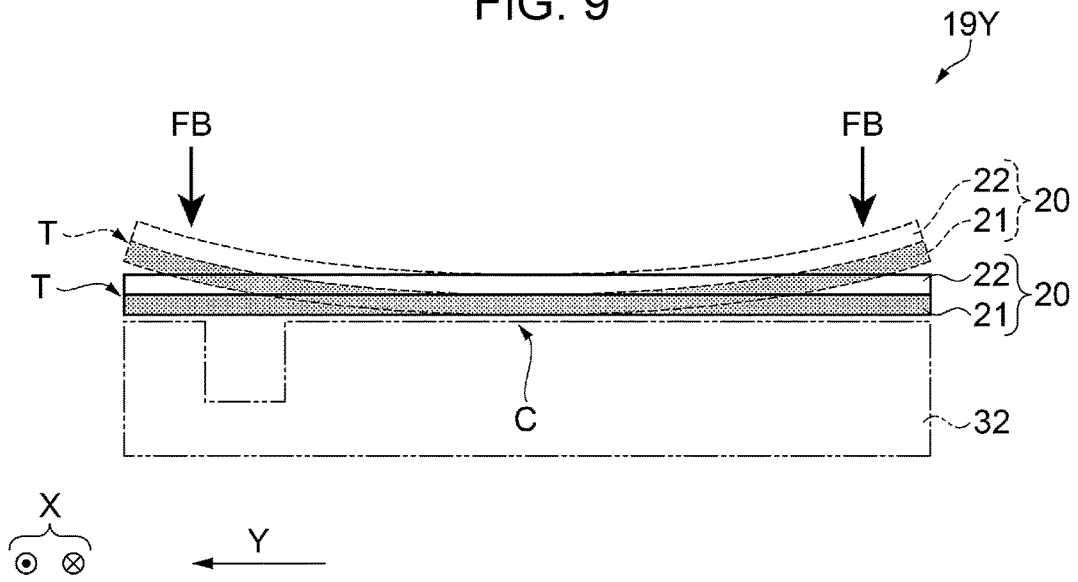
FIG. 9 is a schematic sectional view illustrating a state of a base portion of the medium pressing member according to Modification Example 2.

FIG. 9 is a view corresponding to FIG. 3, and is a schematic sectional view illustrating a state of the base portion of the medium pressing member according to Modification Example 2. In order to easily understand a state of Modification Example 2, in FIG. 9, the attaching portion 23 is omitted, and the medium supporting portion 32 is illustrated in a rectangular shape by a two-dotted chain. Further, in FIG. 9, the medium pressing member 19Y which is not fixed to the medium supporting portion 32 is illustrated by a broken line, and the medium pressing member 19Y which is fixed to the medium supporting portion 32 by the attaching portion 23 (not illustrated) is illustrated by a solid line.

In the medium pressing member 19Y according to the modification example, a shape of the base portion 20 which is not heated by the platen heater 42 is different from that of the medium pressing member 19 according to Embodiment 1.

Hereinafter, the same numeral is given to the same configuration part as that of Embodiment 1, and the modification example will be described based on a difference from Embodiment 1.

As illustrated in FIG. 9, in the base portion 20 of the medium pressing member 19Y according to the modification example, the first material 21 having the high coefficient of thermal expansion and the second material 22 having the low coefficient of thermal expansion are sequentially stacked on the medium supporting portion 32, and this point is the same as Embodiment 1.

As illustrated in FIG. 9 with a broken line, from the center portion C toward the end portion T, at least one of the first material 21 and the second material 22 according to the modification example is processed so as to have a warp which is curved so as to be separated from the medium supporting portion 32. Therefore, in a case in which the base portion 20 of the medium pressing member 19Y according to the modification example is not heated by the platen heater 42 and is not fixed to the medium supporting portion 32, from the center portion C toward the end portion T, the base portion includes the warp which is curved so as to be separated from the medium supporting portion 32. Meanwhile, in a case in which the base portion 20 of the medium pressing member 19 according to Embodiment 1 is not heated by the platen heater 42 and is not being fixed to the medium supporting portion 32, the based portion is disposed along the transporting direction Y, and does not have the curved warp.

Hereinafter, the medium pressing member 19Y (medium pressing member 19Y illustrated by broken like of FIG. 9) which is not fixed to the medium supporting portion 32 is referred to as the medium pressing member 19Y before being attached.

As illustrated by a solid line of FIG. 9, in a case in which the base portion 20 of the medium pressing member 19Y according to the modification example is not heated by the platen heater 42 and is fixed to the medium supporting portion 32, from the center portion C toward the end portion T, the warp which is curved so as to be separated from the medium supporting portion 32 in a direction is corrected, and is disposed along the transporting direction Y. That is, a force FB illustrated by an arrow in the drawing acts on the medium pressing member 19Y before being attached, and the medium pressing member 19Y is fixed to the medium supporting portion 32 in a state in which, from the center portion C toward the end portion T, the warp curved so as to be separated from the medium supporting portion 32 is corrected.

Therefore, in a case in which the medium pressing member 19Y is not heated by the platen heater 42, the force FB acts on the medium pressing member 19Y. The force FB is a force correcting the curved warp, and is a force pressing the medium pressing member 19Y against the medium supporting portion 32. Therefore, even in a case in which heating is not performed by the platen heater 42, since the medium pressing member 19Y becomes in a state of being pressed against the medium supporting portion 32 by the force FB, the member is difficult to be deformed.

Further, if the medium pressing member 19Y is heated by the platen heater 42, the drag force F (refer to FIG. 6) acts with the force FB, and compared to a case in which only the drag force F acts (Embodiment 1), the force pressing the medium pressing member 19Y against the medium supporting portion 32 becomes stronger, and thus the medium pressing member 19Y is more difficult to be deformed.

Therefore, even in a case in which the medium pressing member is increased in size and the medium pressing member is lengthened, the medium pressing member 19Y according to the modification example is more difficult to be deformed, and thus long term reliability or a printing quality of the printing apparatus 11 can be further increased, compared to the medium pressing member 19 according to Embodiment 1.

Also, in the medium pressing member 19Y, a configuration component being processed to have warp which is curved so as to be separated from the medium supporting portion 32, from the center portion C toward the end portion T, may be constituted of only the first material 21, may be constituted of only the second material 22, or may be constituted of both the first material 21 and the second material 22.

As seen from the above, in the modification example, at least one of the first material 21 and the second material 22 has elasticity, and in a case in which the base portion 20 is mounted in the medium supporting portion 32, from the center portion C toward the end portion T, the warp which is curved so as to be separated from the medium supporting portion 32 is included, or in a case in which the base portion 20 is attached to the medium supporting portion 32, the base portion is disposed along the medium supporting portion 32 in a state in which the warp is corrected. With such a configuration, the medium pressing member 19Y is more difficult to be deformed, and thus long term reliability or a printing quality of the printing apparatus 11 can be further increased.

Further, the modification example may be applied to the medium pressing member 190 according to Embodiment 2.

Modification Example 3

A medium pressing member 19X (not illustrated) according to Modification Example 3 is different from the medium pressing member 19 according to Embodiment 1 in terms of the fact that the second material 22 is constituted of a different material. Hereinafter, the same numeral is given to the same configuration part as that of Embodiment 1, and this modification example will be described based on a difference from Embodiment 1.

In the medium pressing member 19X according to Modification Example 3, the first material 21 is constituted of stainless steel for spring (SUS 304), and the second material 22 is constituted of a shape memory alloy (Ni—Ti alloy). Meanwhile, in the medium pressing member 19 according to Embodiment 1, the first material 21 is constituted of stainless steel for spring (SUS 304), and the second material 22 is constituted of stainless steel for spring (SUS 301). That is, the modification example and Embodiment 1 are different from each other in terms of the fact that a configuration material of the second material 22 is different.

The coefficient of thermal expansion of the first material 21 is approximately $17.3\times10^{-6\circ}$ C.$^{-1}$, and the coefficient of thermal expansion of the second material 22 is approximately $10\times10^{-6\circ}$ C.$^{-1}$. Accordingly, the coefficient of thermal expansion of the first material 21 is higher than the coefficient of thermal expansion of the second material 22.

Further, the shape memory alloy constituting the second material 22 memorizes a shape of the warp which is curved so as to be separated from the medium supporting portion 32 in a direction from the center portion C toward the end portion T in a case in which heating is performed by the platen heater 42. That is, the shape memory alloy constituting the second material 22 memorizes a shape (shape of the medium pressing member 19Y before being attached in Modification Example 2) illustrated by a broken line of FIG. 9, in a case in which heating is performed by the platen heater 42.

Then, when the medium pressing member 19X is heated by the platen heater 42, a force changing a shape into the memorized shape (a shape of the warp which is curved so as to be separated from the medium supporting portion 32, from the center portion C toward the end portion T) acts on the second material 22. The force which tends to change to this memorized shape is a force acting in the same direction as the deformation force FA (refer to FIG. 7B).

However, the end portion T of the base portion 20 of the medium pressing member 19X is fixed to the medium supporting portion 32 by the attaching portion 23, even when the force which tends to change to the memorized shape acts on the base portion 20 of the medium pressing member 19X, deformation of the base portion 20 of the medium pressing member 19X is suppressed. That is, even when the force which tends to change to the memorized shape acts on the base portion 20 of the medium pressing member 19X, a force against the force which tends to be changed acts on the base portion 20 of the medium pressing member 19X, and thus deformation of the base portion 20 of the medium pressing member 19X is suppressed.

The force against the force which tends to change to the memorized shape is a force acting in the same direction as the drag force F (refer to FIG. 6), and is a force pressing the medium pressing member 19X against the medium supporting portion 32.

Therefore, when the medium pressing member 19X is heated by the platen heater 42, the force (force pressing the medium pressing member 19X against the medium supporting portion 32) against the force which tends to change to the memorized shape acts on the medium pressing member 19X with the drag force F. Therefore, compared to a case in which only the drag force F acts (Embodiment 1), the force pressing the medium pressing member 19X against the medium supporting portion 32 becomes stronger, and the medium pressing member 19X is more difficult to be deformed.

Therefore, even in a case in which the medium pressing member is increased in size and the medium pressing member is lengthened, the medium pressing member 19X according to the modification example is more difficult to be deformed than the medium pressing member 19 according to Embodiment 1, and thus long term reliability or a printing quality of the printing apparatus 11 can be further increased.

As seen from the above, in a case in which the second material 22 is heated by the platen heater 42, the modification example is constituted of a shape memory alloy (For example, Ni—Ti alloy) in which a shape of the warp which is curved so as to be separated from the medium supporting portion 32 in a direction from the center portion C toward the end portion T is memorizes. Further, in a case in which the base portion 20 is attached to the medium supporting portion 32, the base portion is disposed along the medium supporting portion 32 in a state in which the shape of the warp is corrected.

With such a configuration, the medium pressing member 19X is more difficult to be deformed, and long term reliability or a printing quality of the printing apparatus 11 can be further increased.

Also, the first material 21 is set to a shape memory alloy (For example, Ni—Ti alloy), and the second material 22 may be constituted of a material having a low coefficient of thermal expansion than the first material 21.

Further, the modification example may be applied to the medium pressing member 190 according to Embodiment 2.

Modification Example 4

In a medium pressing member 19W (not illustrated) according to Modification Example 4, the center portion C of the base portion 20 is fixed to the medium supporting portion 32 and is difficult to be deformed in the direction of being separated from the medium supporting portion 32. Further, in the medium pressing member 19W according to the modification example, the coefficient of thermal expansion of the first material 21 is lower than the coefficient of thermal expansion of the second material 22.

This point is a difference between the modification example and Embodiment 1, and hereinafter, the same numeral is given to the same configuration part as that of Embodiment 1, and this modification example will be described based on a difference from Embodiment 1.

In the medium pressing member 19W according to the modification example, the coefficient of thermal expansion of the first material 21 is lower than the coefficient of thermal expansion of the second material 22, and thus when the medium pressing member 19W is heated by the platen heater 42, a force, which increases from the end portion T toward the center portion C, tend to change in the direction of being separated from the medium supporting portion 32 acts on the base portion 20 of the medium pressing member 19W. The center portion C of the base portion 20 of the medium pressing member 19W is fixed to the medium supporting portion 32, and deformation in a direction of being separated from the medium supporting portion 32 is suppressed. That is, when the medium pressing member 19W is heated by the platen heater 42, the force pressing the medium pressing member 19W against the medium supporting portion 32 acts on the medium pressing member 19W, and deformation of the center portion C of the medium pressing member 19W is suppressed.

Therefore, in a case in which the center portion C of the base portion 20 is fixed to the medium supporting portion 32, even when the coefficient of thermal expansion of the first material 21 is lower than the coefficient of thermal expansion of the second material 22, if the medium pressing member 19W is heated by the platen heater 42, the force pressing the medium pressing member 19W against the medium supporting portion 32 acts on the medium pressing member 19W, and the medium pressing member 19W becomes difficult to be deformed.

As seen from the above, in a case in which the center portion C of the base portion 20 is fixed to the medium supporting portion 32, the coefficient of thermal expansion of the first material 21 may be lower than the coefficient of thermal expansion of the second material 22.

Modification Example 5

The printing apparatus including the medium pressing member according to the embodiments or modification examples described above may be a liquid ejecting device which performs recording by ejecting or discharging liquid (including liquid, a liquid body in which particles of a functional material are dispersed or mixed in liquid, a fluid type body such as gel, and solid which is able to flow and be discharged as liquid) other than the ink. For example, the printing apparatus may be a liquid ejecting device which performs recording by ejecting a liquid type member including a material such as an electrode material or a coloring material (pixel material) being used in a manufacture of a liquid crystal display, an electroluminescence (EL) display, a surface emitting display, and the like in a dispersed or dissolved form. In addition, the printing apparatus may be a fluid ejecting device which ejects a fluid type member such as gel (for example, physical gel) or the like. Also, the invention can be applied to any one of the liquid ejecting devices among these devices.

This application claims priority under 35 U.S.C. § 119 to Japanese Patent Application No. 2016-248821, filed Dec. 22, 2016. The entire disclosure of Japanese Patent Application No. 2016-248821 is hereby incorporated herein by reference.

What is claimed is:

1. A printing apparatus comprising:

a medium supporting portion for supporting a medium being transported in a transporting direction;

a printing portion for printing on the medium in a printing region;

a medium pressing member that includes a plurality of materials stacked thereon; and a heating portion for heating the medium pressing member, wherein the medium pressing member includes a base portion being attached to the medium supporting portion, and an eaves portion which forms a gap with the medium supporting portion and suppresses floating of the medium from the medium supporting portion, wherein the base portion includes a first material for forming a first surface being attached to the medium supporting portion, and a second material for forming a second surface on an opposite side of the first surface, wherein a coefficient of thermal expansion of the first material is higher than a coefficient of thermal expansion of the second material, and wherein the heating portion is disposed on an opposite side of the medium pressing member of the medium supporting portion, and heats both the medium pressing member and the medium through the medium supporting portion.

2. The printing apparatus according to claim 1, wherein the medium pressing member includes an attaching portion for attaching the base portion to the medium supporting portion, and wherein the attaching portion includes a first attaching portion which is disposed on an upstream side of the printing region in the transporting direction, and a second attaching portion which is disposed on a downstream side of the printing region in the transporting direction.

3. The printing apparatus according to claim 1, wherein the first material and the second material are metals.

4. The printing apparatus according to claim 1, wherein the first material is a resin, and the second material is a metal.

5. A printing apparatus comprising:

a medium supporting portion for supporting a medium being transported in a transporting direction;

a printing portion for printing on the medium in a printing region;

a medium pressing member that includes a plurality of materials stacked thereon; and a heating portion for heating the medium pressing member, wherein the medium pressing member includes a base portion being attached to the medium supporting portion, and an eaves portion which forms a gap with the medium supporting portion and suppresses floating of the medium from the medium supporting portion, wherein the base portion includes a first material for forming a first surface being attached to the medium supporting portion, and a second material for forming a second surface on an opposite side of the first surface, wherein a coefficient of thermal expansion of the first material is higher than a coefficient of thermal expansion of the second material, and wherein at least any one of the first material and the second material has elasticity, includes a warp curved from a center portion toward an end portion so as to be separated from the medium supporting portion in a case in which the base portion is provided on the medium supporting portion, and is disposed along the medium supporting portion in a state in which the warp is corrected in a case in which the base portion is attached to the medium supporting portion.

6. A printing apparatus comprising:

a medium supporting portion for supporting a medium being transported in a transporting direction;

a printing portion for printing on the medium in a printing region;

a medium pressing member that includes a plurality of materials stacked thereon; and a heating portion for heating the medium pressing member, wherein the medium pressing member includes a base portion being attached to the medium supporting portion, and an eaves portion which forms a gap with the medium supporting portion and suppresses floating of the medium from the medium supporting portion, wherein the base portion includes a first material for forming a first surface being attached to the medium supporting portion, and a second material for forming a second surface on an opposite side of the first surface, wherein a coefficient of thermal expansion of the first material is higher than a coefficient of thermal expansion of the second material, and wherein at least any one of the first material and the second material is constituted of a shape memory alloy which memorizes a shape of the warp curved from the center portion toward the end portion so as to be separated from the medium supporting portion in a case of being heated by the heating portion.

* * * * *